US005544888A

United States Patent [19]

Pellegrini

[11] Patent Number: 5,544,888

[45] Date of Patent: Aug. 13, 1996

[54] GOLF SWING TRAINING DEVICE

[75] Inventor: John T. Pellegrini, Michigan City, Ind.

[73] Assignee: Plane Sight, Inc., Michigan City, Ind.

[21] Appl. No.: 511,128

[22] Filed: Aug. 4, 1995

[51] Int. Cl.[6] ..... A63B 69/36

[52] U.S. Cl. ..... 473/220; 362/102; 362/203; 362/253; 362/259

[58] Field of Search ..... 273/186.3; 362/102, 362/203, 253, 259; 473/220

[56] References Cited

U.S. PATENT DOCUMENTS

| | | | |
|---|---|---|---|
| 3,281,586 | 10/1966 | Gonzalez | 362/102 |
| 3,953,034 | 4/1976 | Nelson | 273/186.3 |
| 4,456,257 | 6/1984 | Perkins | 273/186 R |
| 4,693,479 | 9/1987 | McGwire | 273/186 A |
| 4,913,441 | 4/1990 | Freer | 273/186.3 |
| 4,971,328 | 11/1990 | Hernberg | 273/186 A |
| 5,000,456 | 3/1991 | Rabold | 273/186 A |
| 5,082,282 | 1/1992 | Hernberg | 273/186 A |
| 5,207,429 | 5/1993 | Walmsley et al. | 273/186.2 |
| 5,269,528 | 12/1993 | McCardle, Jr. | 273/186.3 |
| 5,401,030 | 3/1995 | Halliburton | 273/186.3 |

*Primary Examiner*—George J. Marlo

*Attorney, Agent, or Firm*—Gary M. Hartman; Domenica N. S. Hartman

[57] ABSTRACT

A golf swing training device configured to be removably attached to the handle of a standard golf club. The training device includes a light source that generates a parallel light beam, such as a laser beam, which enables a golfer using this device to visually monitor the position of the club with accuracy throughout the golf swing. The light source is enclosed within a pair of housings that are threadably coupled, such that the light source is activated by rotating one of the housings relative to the other. The method of activation employs an elasteromic member that permits current flow from a battery to the light source upon the elastomeric member being sufficiently compressed in order to achieve electrical contact between one of the battery's contacts and the housing in which the elastomeric member is contained.

15 Claims, 2 Drawing Sheets

GOLF SWING TRAINING DEVICE

BACKGROUND OF INVENTION

1. Field of the Invention

This invention generally relates to a golf swing training device for assisting golfers in the visualization of their golf swing. More particularly, this invention relates to an improved golf swing training attachment that utilizes a parallel light source and is readily attachable to a standard golf club. The parallel light source acts as a visible aid to assist a golfer in evaluating and correcting his or her golf swing.

2. Description of Prior Art

The game of golf is played by striking a ball with a club having a shaft, a handle at one end of the shalt with which a golfer grips the club, and a head formed at the other end of the shaft. The head is formed to have a flat surface for striking the ball. To strike the ball successfully, a golfer must take extreme care to contact the ball with a consistent stroke to deliver maximum power and control to the flight of the ball. The game of golf is one in which small deviations from a correct swing often result in poor distance and inconsistent control.

When striking the ball appropriately, golfers must maintain eye contact with the ball. While eye contact is maintained, a golfer must swing the club rearwardly through a back swing that places the club beyond the golfer's view. The club is then swung forward and into the golfer's view, where contact is made with the ball. Lastly, the club is swung beyond the point of contact, and again past the golfer's view during the follow-through. Therefore, during a large portion of the swing, a golfer is unable to see the exact location of his or her club, making it difficult for the golfer to evaluate and correct his or her golf swing in order to optimize contact with the ball.

To resolve this problem, various training devices have been suggested in the prior art to help golfers determine the position of the club when it is not within the field of view during the back swing and follow through. For example, the prior art suggests several devices that utilize a light source to aid golfers in perfecting their golf swings. Generally, such prior art teaches that one or more light sources emitting light from certain locations on a golf club can assist a golfer in determining the position of the club during the swing, and therefore the correctness of his or her swing. For instance, U.S. Pat. No. 4,693,479 to McGwire teaches a light source that can be attached to the club handle such that the light source emits a light beam longitudinally outward from the handle. During the golf swing, the light beam enables the golfer to track the position of the club, and thereby train himself or herself to maintain a golf swing within a single plane through the ball. McGwire's light source is an incandescent bulb that serves to illuminate an area larger than the golf ball for the express purpose of illuminating both the ball and the area surrounding the ball. As those skilled in the art will appreciate, the intensity of McGwire's incandescent bulb is inadequate to permit the device to be used in direct daylight.

Other prior art training devices have suggested the placement of a light source at the head of a golf club. For example, the device taught by U.S. Pat. No. 5,401,030 to Halliburton employs a pair of light emitting diodes mounted to the head of a club, with the emitted light being projected along the shaft so as to be visible to the golfer. A sensor is used to activate the light sources when an appropriate club speed is achieved. The duel light system taught by Halliburton allows the golfer to determine the direction in which the club head is facing. However, as a result of the light sources being located at the club head, the training device taught by Halliburton does not serve to indicate the position of the club during much of the swing, since both the emitted light and the club head are only in view immediately proceeding, during and immediately following contact with the ball.

Furthermore, Halliburton's device must be properly aligned on the club in order to perform correctly. Consequently, the device taught by Halliburton is not well suited for rapid attachment to a golf club. Halliburton's device is also somewhat complicated by the switching mechanism provided by the sensor. Finally, though a light emitting diode is capable of emitting light whose intensity is greater than that of an incandescent bulb because of its more compact source, the light emitted from a light emitting diode is similar to that emitted by an incandescent bulb in that the light is radiated in all directions. Therefore, the device taught by Halliburton does not produce a concentrated beam of light that is focused on a golf ball.

From the above, it can be appreciated that the prior art lacks an uncomplicated golf swing training device that can be readily secured to a golf club to accurately indicate a golfer's swing plane under natural lighting conditions, such as on a golf course or driving range. Accordingly, what is needed is a golf swing training device that can be readily attached to and removed from a standard golf club so as to enable a golfer to practice with the clubs used during actual play of the game, and is able to more precisely indicate the position of the golf club during the majority of the swing and under normal playing conditions.

SUMMARY OF THE INVENTION

It is an object of this invention to provide a golf swing training device adapted to assist a golfer in evaluating and correcting his or her golf swing.

It is further an object of this invention that such a device is removably attachable to a standard golf club, and has an uncomplicated construction that is sufficiently small in size to avoid interference with normal use of the club.

It is another object of this invention that such a device generates a light beam capable of indicating the swing plane of the golf club during use.

It is yet another object of this invention that the light beam has a diameter smaller than that of a golf ball, and is of sufficient intensity to permit use of the device under natural lighting conditions.

In accordance with a preferred embodiment of this invention, these and other objects and advantages are accomplished as follows.

The present invention is generally a training device for use by a golfer to aid in the visualization of his or her golf swing, and thereby assist the golfer in evaluating and correcting his or her swing. Furthermore, the device is adapted to be attached to a standard golf club without interfering with its intended use. More particularly, the device of this invention generates a high-intensity parallel light beam capable of indicating the swing plane of a golf club during use, even under natural lighting conditions.

The training device of this invention includes an enclosure that is adapted to be securely yet removable attached to the handle of a golf club. The enclosure houses a light source that produces the desired parallel light beam, and positions the light source such that the parallel light beam projects from the end of the golf club coaxially along the longitudinal axis of the golf club. In so doing, the light beam is visible during the back swing and follow-through portions of the golf swing, during which the head of the golf club is outside the golfer's field of vision. According to this invention, the diameter of the light beam is less than that of a golf ball, yet is of sufficient intensity so as to be readily visible to the golfer training with the device.

In accordance with the invention, a suitable source for the parallel light beam is a laser, and particularly a laser capable of generating a red or orange light. The laser generates a light beam whose diameter is substantially smaller than that possible with incandescent light sources and light emitting diodes. A laser is able to achieve the objects of this invention due to the ability to generate a concentrated and parallel beam of light without undesirable dispersion, as is the case with radiation-type incandescent bulbs, light emitting diodes and the like. The smaller diameter light beam allows a golfer to have a great deal more accuracy than possible in prior devices, in that the golf swing plane is more precisely indicated with a narrow, high-intensity line or path that the light beam traces on each surface intersected by the beam. Because golf is a game where small deviations from an ideal swing often result in drastically different trajectories of the ball, the higher degree of accuracy provided by this invention is extremely advantageous to golfers.

Another advantage of this invention is that the device is designed such that it is removably attachable to a standard golf club. The training device is equipped with an attachment feature that enables the device to be secured to the handle of a standard golf club, and enables the light beam to be accurately projected coaxially and away from the end of the golf club. Notably, the preferred attachment feature enables the device to be secured to practically any standard golf club that a golfer may choose, rather than having to use a completely different training club than the golfer will normally use when playing the game. This aspect is particularly desirable since many golfers prefer the "feel" of their own clubs.

Yet another advantage is that the device has an uncomplicated design, thereby reducing the overall production costs associated in the manufacture of the device. Therefore, this invention provides the golfer with a novel training device that can be highly cost efficient. Furthermore, the device is preferably equipped with an internal switching mechanism, thereby eliminating any requirement for an external switch that might pose an obstacle during the use of the device. The enclosure is also configured to have a minimal size, thereby further reducing the possibility of unwanted contact with the device, and enabling a golfer to swing the club in a completely ordinary manner.

In use, the golfer attaches the training device of this invention to any golf club that the golfer wants to practice with. After energizing the light source, the golfer can take a normal back swing and be able to determine the position of the club while maintaining eye contact with the ball by observing the path of the light beam as it crosses the ball. As the club is swung forward, the golfer maintains his or her awareness of the position of the club as the light beam again crosses the ball immediately prior to the club coming into view. Finally, after contact with the ball is made and as the club continues forward into the follow-through, the golfer once again can monitor the position of the club by viewing the light beam, which once again comes into view as it crosses the location where the ball originally rested.

While swinging the club at a speed typically used during play, the light beam generates a very bright line that is readily visible on each surface intersected by the beam, and therefore clearly indicates the path of the swing. In this manner, the light beam also generates the swing plane through which the golf club is swung. From the golfer's perspective, a continuous line is generated that extends from the club, terminating at all surfaces intersected by the light beam during the swing. This effect can be better visualized by practicing with the training device within a room, where the linearity of the light beam's path becomes more apparent as it traverses the walls of the room. In this manner, the swing plane defined by the golf swing also becomes more apparent.

Other objects and advantages of this invention will be better appreciated from the following detailed description.

BRIEF DESCRIPTION OF THE DRAWINGS

The above and other advantageous of this invention will become more apparent from the following description taken in conjunction with the accompanying drawings, in which.

DETAILED DESCRIPTION OF THE PREFERRED EMBODIMENT

Figure 1:
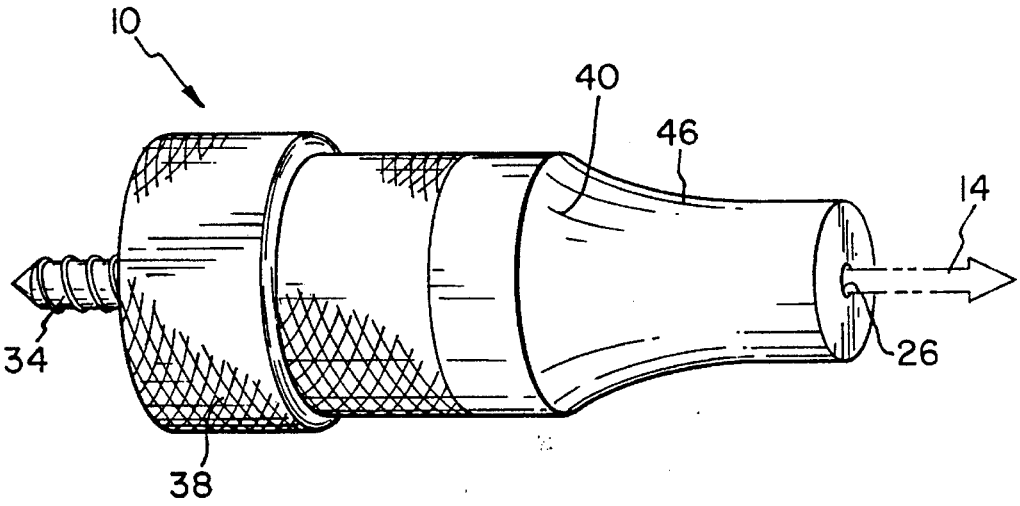
FIG. 1 is a perspective view of a golf swing training device in accordance with a preferred embodiment of this invention.
Figure 2:
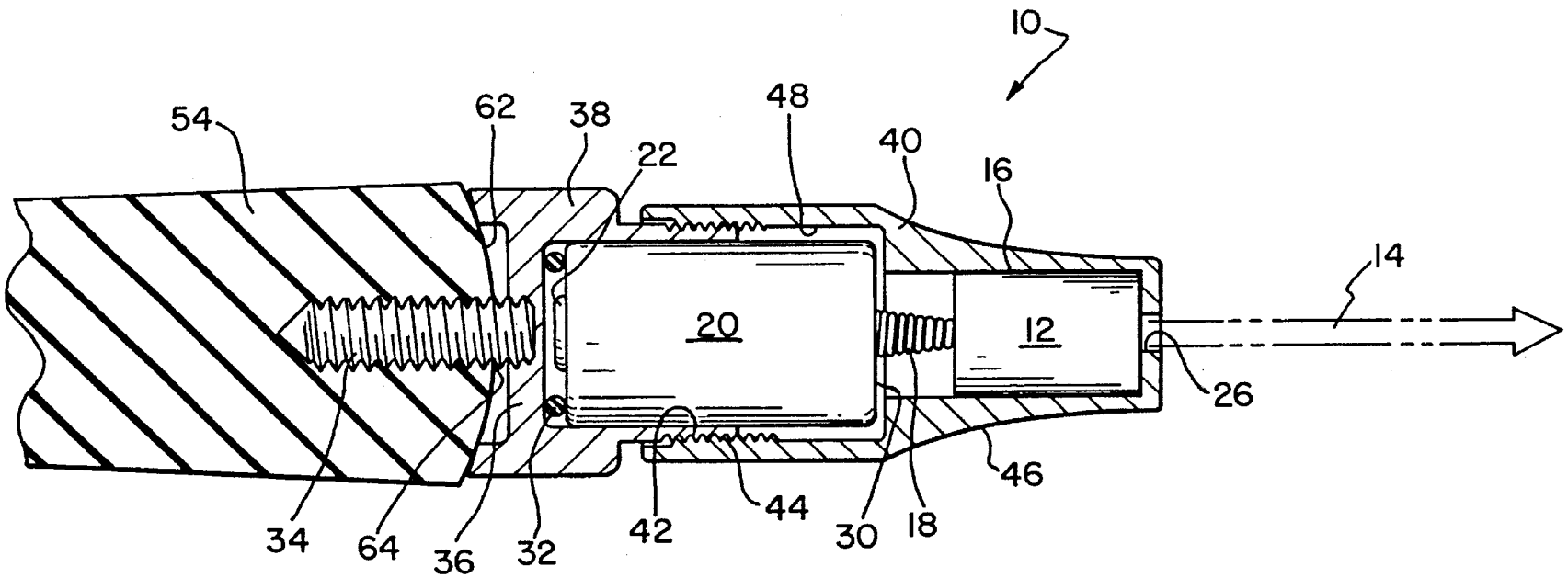
FIG. 2 is a cross-sectional view of the golf swing training device of FIG. 1, shown as being mounted on a handle of a golf club.

FIGS. 1 and 2 show a golf swing training device 10 in accordance with a preferred embodiment of this invention. As can be seen in FIG. 2, the training device 10 of this invention is adapted to be attached to a standard golf club 52, permitting its use in a manner depicted in FIG. 3. The golf club 52 includes a shaft 58, a head 56 attached at one end of the shaft 58 and a handle 54 at the other end of the shaft 58. The head 56 provides a flat surface adapted for striking a golf ball 60, while the handle 54 provides a gripping surface by which a golfer 50 holds the golf club 52. The training device 10 of this invention attaches to the handle 54 as shown in FIG. 2, and projects a light beam 14 along the longitudinal axis of the shaft 58, such that the light beam 14 projects outward from the end of the handle 54 and away from the golf club 52.

According to this invention, the light beam 14 is a parallel light beam, i.e., the rays of the light beam have a very low divergence so as to be approximately parallel. Furthermore, the light beam has a smaller diameter and a higher intensity than that possible with traditional light sources such as incandescent light bulbs, light emitting diodes, and the like. More particularly, this invention preferably utilizes a laser light source 12 energized by a battery 20 to provide a suitable parallel beam of light. In order to be compatible with the intended use of the training device 10, the laser light source 12 must be capable of producing the desired light beam, yet be small enough so as to enable the training device 10 to fit on the golf club 52 without being cumbersome. While the laser light source 12 of this invention is preferred, it is foreseeable that other parallel light sources could also be used.

A preferred laser light source 12 for this invention is a laser diode capable of producing a laser beam having a diameter of less than that of a golf ball, and preferably less than half the diameter of a golf ball, which is generally about four centimeters. More preferably, the light beam 14 maintains a diameter of about five to about seven millimeters at distances of up to about five meters, and a wavelength that provides contrast with the golfer's surroundings to allow the golfer to readily observe the light beam 14. In practice, a preferred light beam 14 is in the orange or red spectrum, with a frequency of about 650 to about 680 nanometers. Laser diodes capable of achieving these objects are available from Quarton U.S.A., Ltd. Co. of San Antonio, Tex., under the model numbers VLM-655-01S and VLM-670-01S, which generate light in the red and orange spectrums, respectively. The laser diodes are also desirable in that they are energized by an operating current of only about fifty to sixty milliamps and an operating voltage of only about three volts. A suitable battery 20 for providing the required operating current and voltage is available from The Kodak Eastman Company.

Equipped with a suitable laser light source 12 as described above, the training device 10 enables the golfer 50 to maintain eye contact with the golf ball 60 while being provided with a visual reference to the position of the club 52 through observation of the intense light beam 14, which inherently follows the swing plane of the club 52 as it is swung by the golfer 50. Furthermore, the uniquely small diameter of the light beam 14 made possible with a parallel light source allows for much greater accuracy than was before possible, in that a more distinct path is produced by the light beam 14. In particular, the small diameter light beam 14 enables the golf swing plane to be more precisely and vividly indicated by a narrow, high-intensity line or path that the beam 14 clearly traces on each surface intersected by the beam 14. Such a capability is impossible with the incandescent bulbs and light emitting diodes taught by the prior art.

The preferred laser diodes noted above are generally represented in FIG. 2. Notably, these preferred laser light sources 12 have a very small cylindrical shape, with a length of about seventeen to eighteen millimeters and a diameter of about ten to eleven millimeters. The outer cylindrical surface 16 of the laser light source 12 forms a first electrical contact for the source 12, while a spring 18 at one end of the source 12 serves as a second electrical contact. Such features render the preferred laser diodes particularly well suited for use in the training device 10 of this invention, in that the electrical continuity with the source 12 can be achieved using an uncomplicated switching technique, as will be described below.

As shown in the Figures, both the laser light source 12 and the battery 20 are protectively enclosed within a housing composed of at least two members, designated as first and second housings 38 and 40, respectively. Generally, parallel light sources such as the preferred laser diodes tend to require substantial protection. Therefore, the first and second housings 38 and 40 of this training device 10 are preferably constructed of a material sufficiently rigid to provide protection to the internal components of the device 10. Preferably, these housings 38 and 40 are constructed from an electrically-conductive, low weight material such as aluminum, though other suitable materials could foreseeably be used. Furthermore, both housings 38 and 40 are generally cylindrical in shape, and together define an internal cavity 48 in which the laser light source 12 and the battery 20 are received. The light source 12 and the battery 20 are arranged such that the spring 18 of the light source 12 electrically contacts a first contact 30 of the battery 20, while the outer surface 16 of the light source 12 electrically contacts the second housing 40.

The first housing 38 forms a base 36 from which a threaded fastener 34 extends as an attachment feature for the device 10. The threaded fastener 34 enables the training device 10 to be quickly attached and removed from the golf club 52 by being threaded into an opening 64 formed in the end 62 of the golf club handle 54, with the base 36 of the first housing 38 being securely abutted against the end 62 of the handle 54 when the training device 10 is properly installed. In this manner, the training device 10 is oriented to be substantially parallel with the longitudinal axis of the shaft 58 of the golf club 52. Preferably, the diameter of the first housing 38 is approximately equal to that of the handle 54, with the second housing 40 having a tapered portion 46 such that the distal end of the training device 10 is substantially less than that of the first housing 38 and the handle 54. An opening 26 is formed in the second housing 40 through which the light beam 14 is emitted. The opening 26 must be large enough for the light beam 14 to pass therethrough uninterrupted, necessitating a diameter of at least about five millimeters.

The first and second housings 38 and 40 have complementary threads 42 and 44 that enable the housings 38 and 40 to be threaded together, as shown in FIG. 2. This arrangement provides for a unique feature of this invention by which the laser light source 12 is energized through electrical contact with the battery 20. More particularly, this arrangement enables a golfer to turn the laser light source 12 on and off by merely rotating the second housing 40 relative to the first housing 38, without any externally protruding switch. This method of activation relies on the presence of an elastomeric member 32 between the battery 20 and the base 36 of the first housing 38. As shown, the elastomeric member 32 is an O-ring composed of rubber or another suitably elastic and nonconducting material, though it is foreseeable that various other shapes and materials could be used for the elastomeric member 32. The base 36 serves as an internal contact between the first housing 38 and a second contact 22 of the battery 20. As such, current flows from the battery 20 to the light source 12 upon the elastomeric member 32 being sufficiently compressed in order to permit electrical contact between the base 36 and the battery's second contact 22. More particularly, as the second housing 40 is threaded down onto the first housing 38, the internal cavity 48 of the training device 10 is reduced. In so doing, the laser light source 12 is urged toward the battery 20, causing the battery 20 to compress the elastomeric member 32 until the contact 22 abuts against the base 36, thereby completing the battery-light source circuit. When the training device 10 is no longer required, it can be turned off by rotating the second housing 40 in an opposite direction as was required to activate the training device 10. As shown in FIG. 1, knurls are preferably present on the first and second housings 38 and 40 in order to make it easier for the golfer 50 to rotate the second housing 40 relative to the first housing 38.

In use, the golfer 50 attaches the training device 10 to any golf club 52 that the golfer 50 wishes to practice with. The golfer 50 screws the threaded fastener 34 of the training device 10 into the opening 64 formed in the end 62 of the handle 50. Once securely attached to the golf club 52, the training device 10 is activated by rotating the second housing 40 until contact is made between the contact 22 of the battery 20 and the base 36 of the first housing 38, causing the laser light source 12 to generate and emit the parallel light beam 14.

Figure 3:
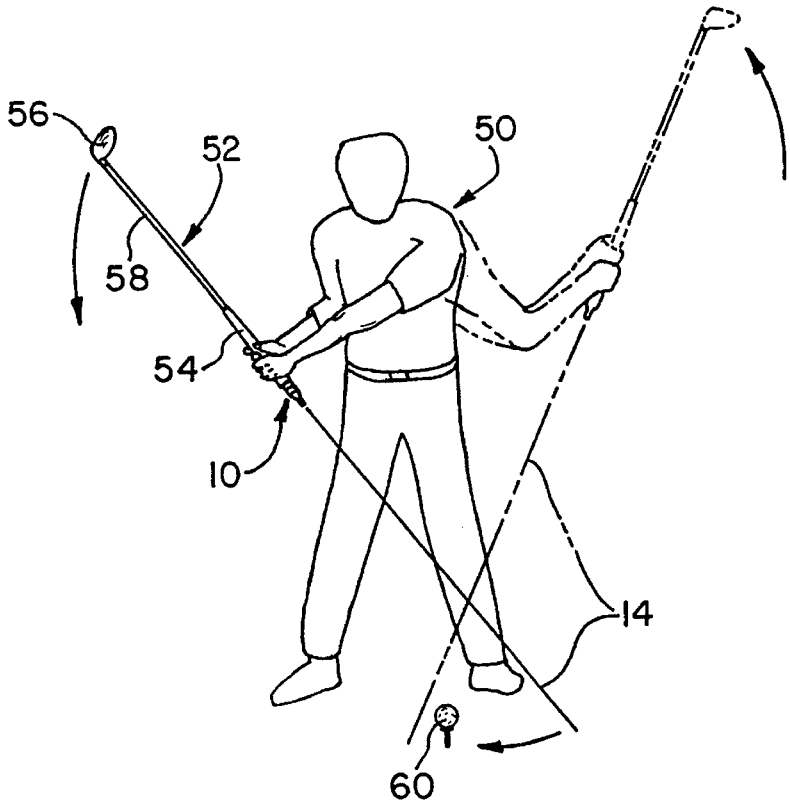
FIG. 3 illustrates the use of the golf swing training device of FIG. 1, in which the device is shown emitting a narrow beam of parallel light in a direction away from the head of the club during the back swing and, in phantom, during the follow-through portions of the golf swing.

With reference to FIG. 3, the golfer 50 can use the golf swing training device 10 with the following effect. When the golf club 52 is swung backwards, the golfer 50 is able to discern the position of the club 52 while maintaining eye contact with the ball 60 by monitoring the path of the emitted light beam 14 on the surface supporting the ball 60. A proper back swing requires that the path of the light beam 14 cross the approximate center of the ball 60. As the golfer 50 begins to swing the golf club 52 forward, the light beam 14 should retrace its original path across the ball 60, all while the golfer 50 maintains eye contact with the ball 60. As the golf club 52 continues to be swung forward, the light beam 14 passes out of the golfer's field of vision while eye contact with the ball 60 is maintained. Soon thereafter, the golfer 50 is again aware of the position of the club 52 as the head 56 of the club 52 comes into view and makes contact with the ball 60. Finally, as the club 52 continues forward during the follow-through, the golfer 50 once again can monitor the position of the golf club 52 by viewing the light beam 14 as it reenters the golfer's field of vision, as shown in phantom in FIG. 3. Specifically, if a proper form is maintained, the golfer 50 will see the light beam 14 retrace the path across the location where the ball 60 rested, all while keeping his or her head down.

Advantageously, while swinging at a speed typically used during play, the path traced by the beam 14 will be vivid and appear as a relatively continuous line on the surfaces intersected by the beam 14. Using the preferred laser light source 12, this line will be bright red or orange, and readily visible even under natural lighting conditions. The enhanced visibility made possible by this invention clearly delineates the golf swing plane, a result essential for providing useful feedback to a golfer while training with the device 10.

Those skilled in the art will appreciate the significant advantages of the training device 10 of this invention when used in the manner described above. First, the parallel light beam 14 is very intense and localized, such that its path is more readily discernable by the golfer 50. The beam 14 is not scattered around the ball 60 as taught by the prior art, but instead traces a narrow path that is readily visible even under natural lighting conditions. Secondly, the elastomeric member 32 provides a very inexpensive switching mechanism that maintains a continuous compression load on the internal components of the training device 10, thereby preventing damage to the components if the device 10 is jostled or dropped. Energizing the light source 12 merely requires that the elastomeric member 32 be sufficiently compressed to achieve electrical contact between the contact 22 on the battery 20 and the base 36 of the first housing 38. The first and second housings 38 and 40 form the remainder of the electrical circuit between the battery 20 and the light source 12, such that minimal components are required not only to complete the circuit, but also to manufacture the training device 10.

The use of the laser light source 12, and particularly the laser diodes described above, also provides advantages unique to this invention. First, and as noted above, a laser beam exemplifies the characteristics of the parallel light beam 14 required by this invention. Furthermore, the monochromatic nature of a laser beam enables the beam 14 to be even more readily visible if the golfer 50 wears glasses designed to filter a portion of the light outside of the wavelength range of the beam 14. The laser beam 14 employed by this invention also produces a narrow and therefore more vivid line or path on surfaces intersected by the beam 14, and hence enables the swing plane to become much more apparent to the golfer 50, particularly if practiced within a room that enables the path of the beam 14 to be readily observed on its walls. An additional technique possible with this invention is to introduce a reflective gaseous medium into the area in which the device 10 is being used, such that the entire path of the light beam 14 is viewable through reflection by the medium. For instance, vapors from dry ice could be introduced into a room, allowing the golfer better visualization of the particular position of the golf club 52 and the swing plane, since a significant portion of the length of the beam 14 becomes visible.

While our invention has been described in terms of a preferred embodiment, it is apparent that one skilled in the art could adopt other forms—for example, by modifying the appearance or structure of the golf swing training device 10, or by substituting appropriate materials. Accordingly, the scope of our invention is to be limited only by the following claims.

The embodiments of the invention in which an exclusive property or privilege is claimed are defined as follows:

1. A golf swing training device for use on a golf club having a shaft defining a longitudinal axis of the golf club, a head at a first end of the shaft and a handle at an oppositely-disposed second end of the shaft, the golf swing training device comprising:

means for producing a parallel light beam;

means for attaching the producing means to the handle of the golf club such that the parallel light beam is emitted coaxially along the longitudinal axis of the shaft of the golf club in a direction away from the head of the golf club; and means for switching the producing means between an activated state in which the producing means emits the parallel light beam and a deactivated state in which the parallel light beam is not emitted, the switching means comprising an elastomeric member and means for compressing the elastomeric member to permit current flow to the producing means when the producing means is in the activated state.

2. A golf swing training device as recited in claim 1 wherein the producing means is a laser light source.

3. A golf swing training device as recited in claim 1 wherein the parallel light beam has a wavelength spectrum chosen from the group consisting of red and orange light.

4. A golf swing training device as recited in claim 1 wherein the training device further comprises a housing enclosing the producing means.

5. A golf swing training device as recited in claim 4 wherein the producing means comprises a laser generating device and a battery for powering the laser generating device, and wherein the housing comprises first and second portions, the first portion comprising a cavity for receiving the laser generating device and an aperture through which the parallel light beam is emitted, the second portion comprising the attachment means and having a cavity receiving the battery and the elastomeric member.

6. A golf swing training device as recited in claim 5 wherein the first portion of the housing is tapered so as to have a diameter less than a diameter of the second portion of the housing.

7. A golf swing training device as recited in claim 5 wherein the first and second portions of the housing are threadably coupled.

8. A golf swing training device as recited in claim 1 wherein the attachment means comprises a threaded fastener.

9. A golf swing training device for use on a golf club having a shaft defining a longitudinal axis of the golf club, a head at a first end of the shaft and a handle at an oppositely-disposed second end of the shaft, the golf swing training device comprising:

a housing;

a laser generating device enclosed in the housing;

means for switching the laser generating device between an activated state in which the parallel light beam is emitted and a deactivated state in which the parallel light beam is not emitted, the switching means comprising an elastomeric member and means for compressing the elastomeric member to permit current flow to the laser generating device when the laser generating device is in the activated state; and means for attaching the housing to the handle of the golf club such that the parallel light beam is emitted coaxially along the longitudinal axis of the shaft of the golf club in a direction away from the head of the golf club.

10. A golf swing training device as recited in claim 9, wherein the laser generating device comprises:

a laser diode module;

first and second contacts on the laser diode module;

a battery having first and second battery contacts, the first battery contact being in electrical contact with the first contact of the laser diode module; and the elastomeric member disposed between the second battery contact and the second contact of the laser diode module so as to enable selective powering of the laser diode module with the battery by compression of the elastomeric member.

11. A golf swing training device as recited in claim 10, wherein the housing comprises a first portion threadably coupled with a second portion, such that the elastomeric member is compressible by rotating the first portion relative to the second portion.

12. A golf swing training device as recited in claim 10 wherein the elastomeric member comprises an O-ring.

13. A golf swing training device as recited in claim 9 wherein the parallel light beam is chosen from the group consisting of red and orange light, and has a wavelength of between about 650 and about 680 nanometers.

14. A golf swing training device as recited in claim 9 wherein the laser generating device comprises a laser diode module and a battery for powering the laser diode module, and wherein the housing comprises first and second portions, the first portion comprising a cavity for receiving the laser diode module and an aperture through which the parallel light beam is emitted, the second portion comprising the attachment means and having a cavity that receives the battery and the elastomeric member.

15. A golf swing training device for use on a golf club having a shaft defining a longitudinal axis of the golf club, a head at a first end of the shaft and a handle at an oppositely-disposed second end of the shaft, the golf swing training device comprising:

a housing comprising a first portion having a first cavity and a second portion having a second cavity, the first and second portions being threadably coupled together;

a laser light source producing a parallel light beam having a wavelength of about 650 to about 680 nanometers, the laser light source being disposed in the first cavity of the housing and having a first contact contacting the first portion of the housing and a second contact facing the second portion of the housing;

a battery disposed in the second cavity of the housing, the battery having a first battery contact and having a second battery contact in electrical contact with the second contact of the laser light source;

an O-ring disposed between the first battery contact and the second portion of the housing such that when the first portion of the housing is rotated relative to the second portion of the housing, the O-ring is compressed so as to enable the first battery contact to electrically contact the second portion of the housing; and means for attaching the housing to the handle of the golf club such that the parallel light beam is emitted coaxially along the longitudinal axis of the shaft of the golf club in a direction away from the head of the golf club.

* * * * *